US008371953B2

(12) United States Patent
Baer, Jr.

(10) Patent No.: US 8,371,953 B2
(45) Date of Patent: Feb. 12, 2013

(54) GOLF TRAINING AIDE

(76) Inventor: James L. Baer, Jr., Glenside, PA (US)

( * ) Notice: Subject to any disclaimer, the term of this patent is extended or adjusted under 35 U.S.C. 154(b) by 0 days.

(21) Appl. No.: 13/292,265

(22) Filed: Nov. 9, 2011

(65) Prior Publication Data

US 2012/0115624 A1 May 10, 2012

Related U.S. Application Data

(60) Provisional application No. 61/411,745, filed on Nov. 9, 2010.

(51) Int. Cl.
*A63B 69/36* (2006.01)

(52) U.S. Cl. ..... 473/212; 473/214; 473/409

(58) Field of Classification Search ..... 473/201, 473/205, 207, 212, 214, 219, 227, 266, 268, 473/269, 276, 409
See application file for complete search history.

(56) References Cited

U.S. PATENT DOCUMENTS

| | | | | |
|---|---|---|---|---|
| 4,241,922 | A | 12/1980 | Elliott, Jr. | |
| 4,896,887 | A * | 1/1990 | Cable | 473/212 |
| 5,116,057 | A | 5/1992 | Mangiaracina | |
| 5,248,146 | A * | 9/1993 | Viets et al. | 473/206 |
| 5,259,621 | A * | 11/1993 | Keefer | 473/212 |
| 5,445,385 | A | 8/1995 | Brooks | |
| 5,447,312 | A * | 9/1995 | Nixon et al. | 473/212 |
| 5,501,464 | A * | 3/1996 | Dalbo | 473/213 |
| 5,667,447 | A | 9/1997 | Perham et al. | |
| 5,743,806 | A | 4/1998 | Brennan | |
| 5,823,980 | A | 10/1998 | Kopfer | |
| 6,027,413 | A | 2/2000 | Smith et al. | |
| 6,508,721 | B1 * | 1/2003 | Kriser | 473/298 |
| 6,656,056 | B1 | 12/2003 | Leonard | |
| 7,976,398 | B2 * | 7/2011 | Clawson | 473/212 |
| 2009/0239674 | A1 * | 9/2009 | Huffman et al. | 473/213 |

FOREIGN PATENT DOCUMENTS

WO 0006262 A1 2/2000

* cited by examiner

*Primary Examiner* — Nini Legesse
(74) *Attorney, Agent, or Firm* — Caesar, Rivisc, Bernstein, Cohen & Pokotilow, Ltd.

(57) ABSTRACT

A golf training aide includes a pair of sleeves adapted to be placed on a golfer's arms. Each sleeve includes a pair of visually distinguishable sections, such that when the sleeves are properly positioned on the golfer's arms one of the visually distinguishable sections of each sleeve will face forwardly at the end of a proper backswing of a golf club and the other of the pair of visually distinguishable sections of each sleeve will face forwardly at the end of the forward swing of the golf club.

10 Claims, 5 Drawing Sheets

GOLF TRAINING AIDE

RELATED APPLICATIONS

This application claims the benefit of the Nov. 9, 2010 filing date of provisional application Ser. No. 61/411,746.

BACKGROUND OF THE INVENTION

1. Field of Invention

This invention relates to generally to a golf training aide and more specifically, to a golf training aide adapted to combine the three most common styles of learning; namely, visual, kinesthetic and auditory.

2. Description of Related Art

Numerous devices and methods have been suggested to aid or train a golfer to employ a proper golf swing when putting, chipping, pitching or engaging in a full swing, such as when driving the ball or otherwise using an iron.

U.S. Pat. No. 4,241,922 discloses the use of a single member for encircling the forearm and wrist of a golfer, which employs a hand-restriction portion.

U.S. Pat. No. 5,116,047 employs a cuff for attachment about the wrist of a golfer and includes a Velcro attachment section for attachment to a complementary Velcro section of a sleeve attached to a golf club.

U.S. Pat. No. 5,445,385 discloses the use of a sleeve that is worn on a golfer's arm in a position straddling the user's elbow to thereby mechanically minimize bending of the golfer's arm.

U.S. Pat. No. 5,667,447 discloses a sleeve that is worn to straddle a golfer's elbow and includes a flexure e-sensor as part of the construction.

U.S. Pat. No. 5,743,806 employs a flexible sleeve worn on a golfer's arm and including a pocket that contains a lengthwise, concave metal strip positioned on the outside of the player's elbow.

International Publication No. WO2000006262 discloses a sleeve for restricting movement of the leading arm of a golfer, which includes a longitudinal pocket in which a strip of substantially inflexible material is retained.

Although some of the training aides disclosed in the prior art may provide some benefits, a need exists for a unique, simple golf training aide that is easily useable by a golfer. It is to such a simplified training aide or developing an efficient golf swing that the present invention relates.

SUMMARY OF THE INVENTION

A golf training aide in accordance with the present invention includes a pair of sleeves adapted to be placed on a golfer's forearm, each sleeve including a pair of visually distinguishable sections as part of the construction. The sleeves are properly positionable on the golfer's arms to orient one of the visually distinguishable sections of each sleeve facing forwardly at the end of a proper backswing of a golf club and to orient the other of the pair of visually distinguishable sections of each sleeve facing forwardly at the finish of the forward swing of the golf club.

Reference throughout this application to a section of the sleeves "facing forwardly" refers to the section that is viewable by an individual located in front of the golfer or by the golfer when used in front of a mirror while doing exercises.

In the most preferred construction, each of the sleeves includes an additional, or third, visually distinguishable section that is adapted to be aligned in a predetermined position on each aim of the golfer to permit proper placement of the sleeves on the golfer's arms and also to cooperate in defining a generally V configuration when a golf club is being properly gripped by the golfer when addressing the golf ball and/or during the set up of the golf swing to permit the training aide of this invention to work more efficiently.

In a preferred construction the additional visually distinguishable section of each sleeve is an elongate section positioned between the pair of visually distinguishable sections.

In a preferred construction each of the sleeves includes at least one elastic section to thereby render the sleeve generally elastic to firmly engaging the forearm of the golfer.

In a preferred embodiment of the invention the additional, or third, visually distinguishable section of each sleeve has a transverse, or circumferential dimension that is narrower that the transverse or circumferential dimension of each section of the pair of visually distinguishable sections, and this additional visually distinguishable section is employed to establish a proper orientation of each sleeve on a respective forearm of a golfer.

In the preferred construction of this invention each of the sleeves is a closed member having a generally circular cross-section and a generally conical, lengthwise configuration.

In use, the sleeves are placed firmly about the forearms of a golfer below the elbows with the additional, or third, visually distinguishable section positioned to be aligned with the crook between the golfer's thumb and forefinger and extending up the middle of the forearm toward the shoulder socket when the forearms are in their natural, physical hanging position.

The golfer then is instructed to grip the club so that the additional visually distinguishable sections of the sleeves cooperate with each other to define a generally V-shape when viewed by a person standing in front of the golfer or when viewed by a golfer looking in the mirror. It should be understood that the "V" configuration will be viewed up-side-down by the golfer when the golfer is looking directly at the area of the club being gripped.

During initial, proper movement of the golfer's shoulders, causing the golfer's arms to move approximately six to eight inches, the additional, visually distinguishable sections of each of the sleeves cooperate to remain in substantially the same V-shape orientation as when the ball initially was addressed.

When the sleeves are properly positioned on the forearms of the golfer, and the golfer employs a proper swing, one of the visually distinguishable sections of each sleeve will face forwardly, or outwardly, at the end of a proper backswing of the golf club and the other of the pair of visually distinguishable sections of each sleeve will face forwardly, or outwardly, at the finish of a proper forward swing of the golf club.

Details of the orientation of the pair of visually distinguishable sections and the additional visually distinguishable section of each sleeve during various phases of a proper golf swing will be described in greater detail later in this application.

All references cited herein are incorporated herein by reference in their entireties.

DESCRIPTION OF THE BEST MODE OF THE INVENTION

Figure 1:
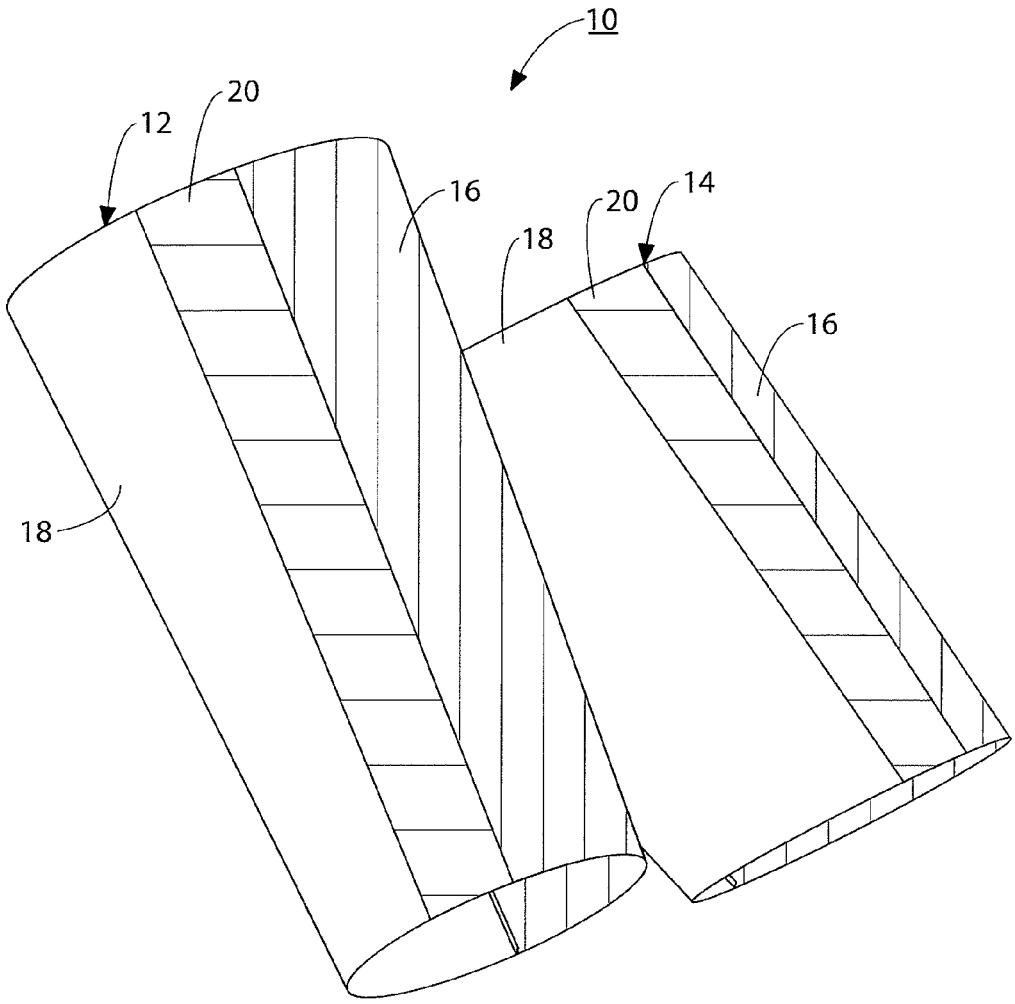
FIG. 1 is an isometric view of a golf training aide in accordance with this invention.

A golf training aide in accordance with a preferred embodiment of this invention is generally illustrated at 10 in FIG. 1.

In the preferred embodiment of this invention the golf training aide 10 includes a pair of sleeves 12, 14 of identical construction. These sleeves of this invention can be used in training both right and left-handed golfers, and as illustrated and discussed herein is being employed by a right-handed golfer.

In the preferred embodiments the sleeves 12, 14 are generally flexible, elastic, closed members that are conical in shape and designed to firmly engage the forearms of a golfer.

Figure 2:
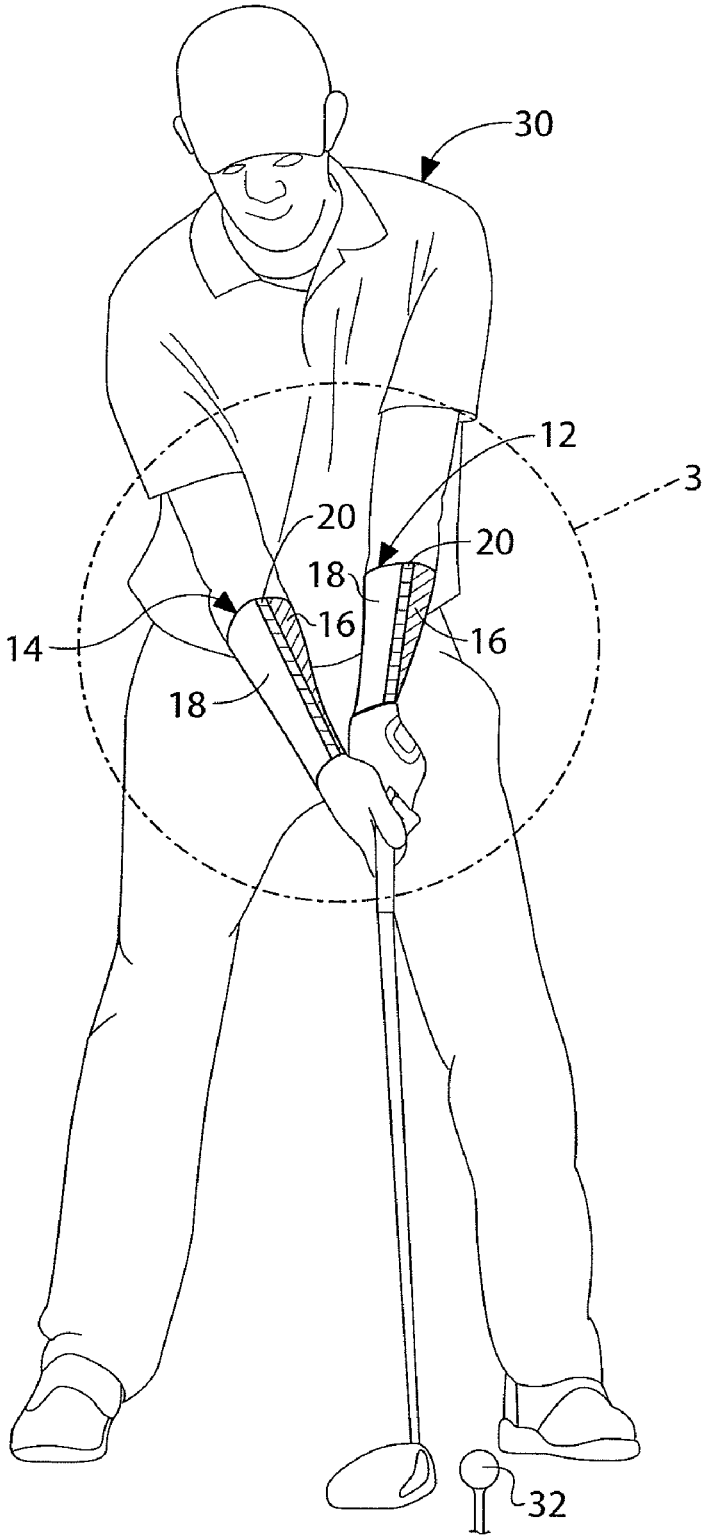
FIG. 2 is a front view showing the golf training aid of this invention positioned on a golfer's forearm at the address position, which is basically the beginning of the swing.
Figure 3:
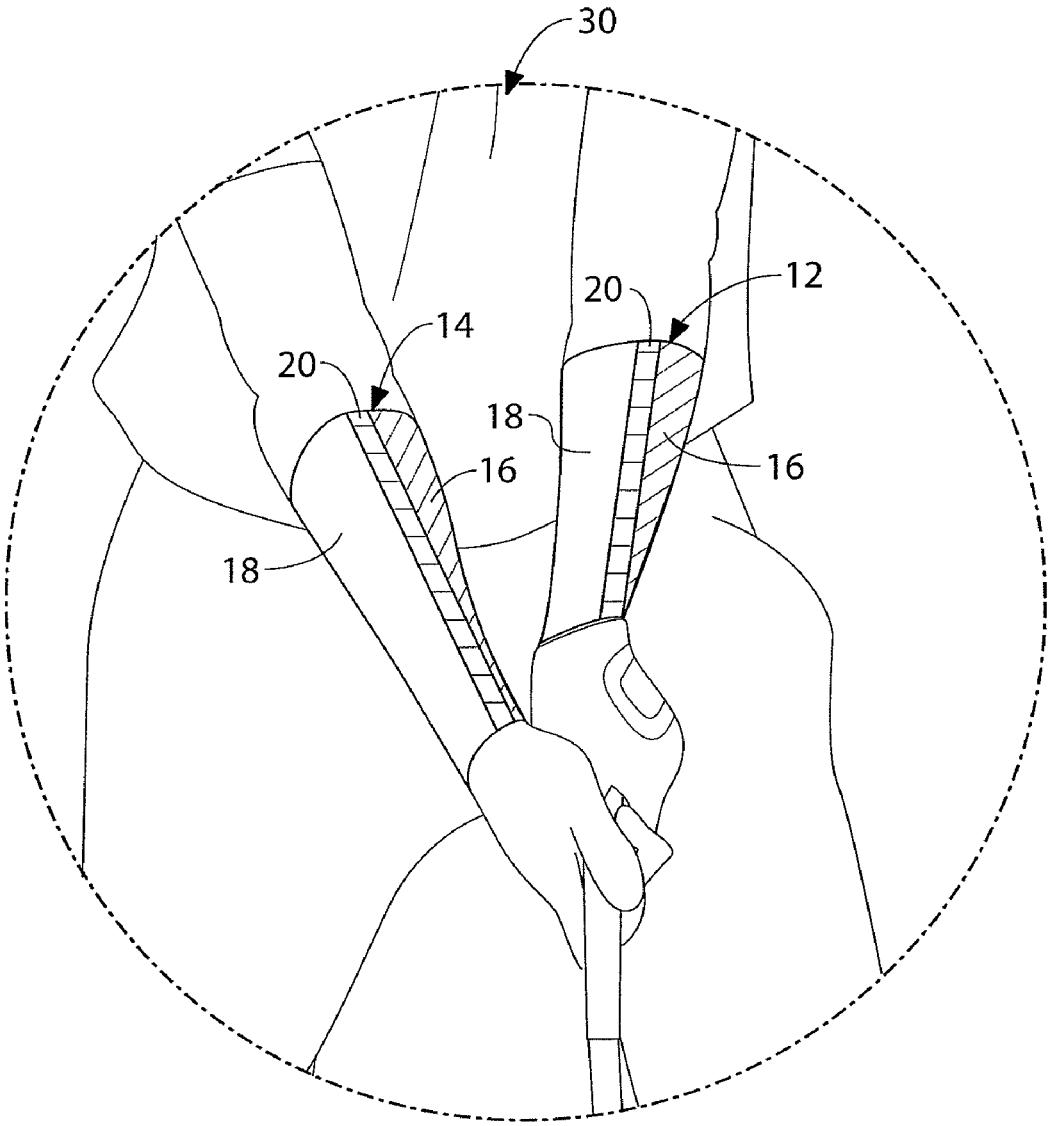
FIG. 3 is an enlarged view of the circled area identified as "3" in FIG. 2.

As shown in FIGS. 1-3, each of the sleeves 12, 14 includes a pair of visually distinguishable panels, or sections, 16, 18, preferably having visually distinguishing colors.

The sleeves 12, 14 preferably also include an additional, elongate section, or panel, 20 that is circumferentially narrower than the circumferential dimension of panels 16, 18 and is visually distinguishable from the panels 16 and 18, preferably by being of a different color or pattern. These elongate, narrow, panels 20 are employed to properly orient the sleeves on the respective forearms of a golfer at the start of a golf swing, as will be discussed in greater detail hereinafter.

As is clearly shown in FIGS. 2 and 3, sleeves 12 and 14 are properly positioned on the left and right forearms of a golfer 30 by aligning the narrow panels 20 of each sleeve, with the crook between the thumb and forefinger of the golfer's left and right hands, respectively, and extending upwardly toward the left and right shoulders, respectively. In this orientation the visually distinguishable sections 16 face to the right on the golfer's left and right arms, in the direction of the intended flight of the ball, and the other visually distinguishable sections 18 face to the left on the golfer's left arm, in a direction opposed to the direction of intended flight of the ball.

Reference to the direction or orientation in which various sections 16, 18 and 20 face or extend are as those sections are viewed from a position in front of the golfer 30 or in a mirror In a representative embodiment, the panels 16 (facing to the left as viewed by the golfer) can be red, the panels 18 (facing to the right as viewed by the golfer) can be white and the narrow, positioning panels 20 can be blue. Also, it should be understood that the relative dimensions of the panels, particularly in the transverse, or circumferential direction, can be varied to accommodate forearms of different sizes and to insure that these panels 16, 18 and 20 become oriented in a proper direction during a proper golf swing.

Obviously, many other colors can be employed, if desired, and in addition, other systems or patterns can be employed to provide panels that are visually distinguishable from each other. The particular manner in which the various sections are made distinguishable from each other does not constitute a limitation on the broadest aspects of this invention.

Referring to FIGS. 2 and 3, the orientation and position of the pair of sleeves 12 and 14 on the left and right forearms of the golfer, respectively, are illustrated with the golfer in a position addressing the golf ball. As should be noted in this position, the narrow panels 20 of the left and right sleeves 12 and 14 preferably have an identical visual appearance and are oriented relative to each other to form a generally "V" configuration, when the sleeves 12 and 14 are in proper position on the golfer's left and right forearms and the club face is in proper position addressing the golf ball 32, as seen in FIG. 2.

In the training function the golfer 30 is instructed to maintain the above-described V-shaped orientation during the initial portion of the backswing of the club, e.g., after movement of the golfer's shoulders so that the arms move about six to eight inches from the vertical position. Specifically, if the initial part of the backswing is carried out properly the visually distinguishable sections 20 of the sleeves 12 and 14 should be maintained in the same orientation as when the golf ball is being addressed.

It also should be understood that the golfer 30 will be taught to maintain this latter orientation of the sections 20 during limited movement of the club, such as when a golfer is putting or chipping.

It also should be noted that the pair of visually distinguishable sections 16 and 18 of the sleeves 12 and 14 likewise will be maintained in the same position or orientation during this initial portion of the backswing, assuming that the initial portion of the backswing is carried out in a proper manner.

The next checkpoint during the golf swing, which is not illustrated in the drawings, is when the left arm is parallel to the ground during the backswing. In this position, if the swing has been carried out in the proper manner, only the visually distinguishable sections 16 should be viewable from a position in front of the golfer or from a reflection in a mirror, with the additional, visually distinguishable sections 20 facing upwardly with the "V" formation of panels 20 being the same as when the golf ball 32 was initially addressed, as shown in FIG. 2. If this latter orientation of the visually distinguishable sections 16 and 20 is maintained the golfer will have carried out the initial portion of the swing to open the club face correctly while keeping the club face square to the swing plane.

Figure 4:
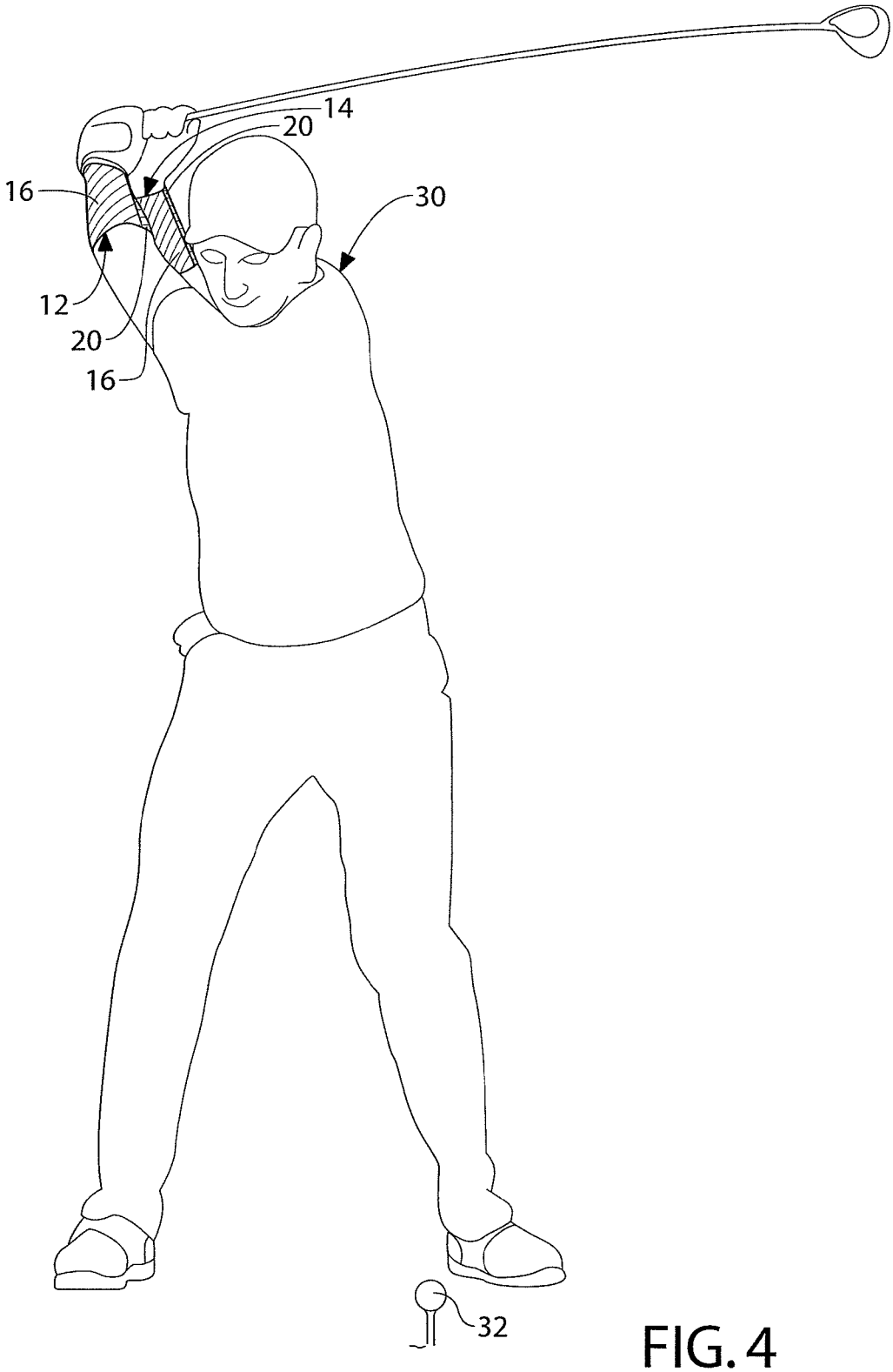
FIG. 4 shows the position of a golfer at the end of a proper backswing.

Referring to FIG. 4 the orientation of the sleeves 12 and 14 is illustrated at the top of a golfer's backswing, assuming that the backswing was completed in a proper fashion. Specifically, in this orientation only the visually distinguishable sections 16 of the sleeves 12, 14 are viewable from a position in front of the golfer or from a reflection in a mirror, with the lower portion of the right forearm located just below the left forearm.

By carrying out the backswing in a manner that positions the sleeves 12 and 14 in the orientation described above, the golfer will have been taught to maintain a proper spine angle, shift weight correctly and create a proper position at the top of the backswing that is established by movement through a proper swing plane that creates a torque in the body establishing the required source of power during the forward portion of the swing.

The next checkpoint during the golf swing is when the golfer has returned the clubface back to the ball 32, which is the impact position. In this impact position the golfer's forearms and the sleeves thereon should be in the same orientation and position that they occupied when the ball 32 was being addressed, as is shown in FIGS. 2 and 3. That is, the narrow, visually distinguishable sections 20 of the sleeves 12 and 14 form the "V" configuration with the bottom of the "V" pointing at the butt of the club and the two arms of the "V" pointing generally to respective shoulders of the golfer. In this latter position the pair of visually distinguishable sections 16 and 18 of each of the sleeves 12 and 14 are both visible from a position in front of the golfer or from a reflection in a mirror, in the same manner as when the golfer is properly addressing the ball 32 as is shown in FIGS. 2 and 3.

The pair of sleeves 12 and 14 forming the training device 10 thereby teach the golfer to deliver or direct the clubface back to the ball squarely with full extension, utilizing the centrifugal force to create an efficient golf swing. Thus, by employing the sleeves 12, 14 to establish a proper golf swing the golfer 30 has created more power with less effort resulting in the golf ball 32 being driven a greater distance and with more accuracy than is achieved when the downswing is carried out in an improper manner.

The next checkpoint during the golf swing, which is not illustrated in the drawings, is after the impact position when the pair of visually distinguishable sections 16, 18 switch orientations from the orientations existing at the end of the backswing. That is, after impact the visually distinguishable sections 18 face forwardly and the visually distinguishable sections 16 face rearwardly, assuming that the golf swing is carried out properly. That is, at this point in the swing the golf training sleeves 12, 14 teach the golfer to release the club head, thereby finalizing the effect of a proper backswing and maximizing the power created up to this point in the golf swing, allowing the clubface to strike the golf ball more consistently square resulting in straighter, longer shots more often.

Figure 5:
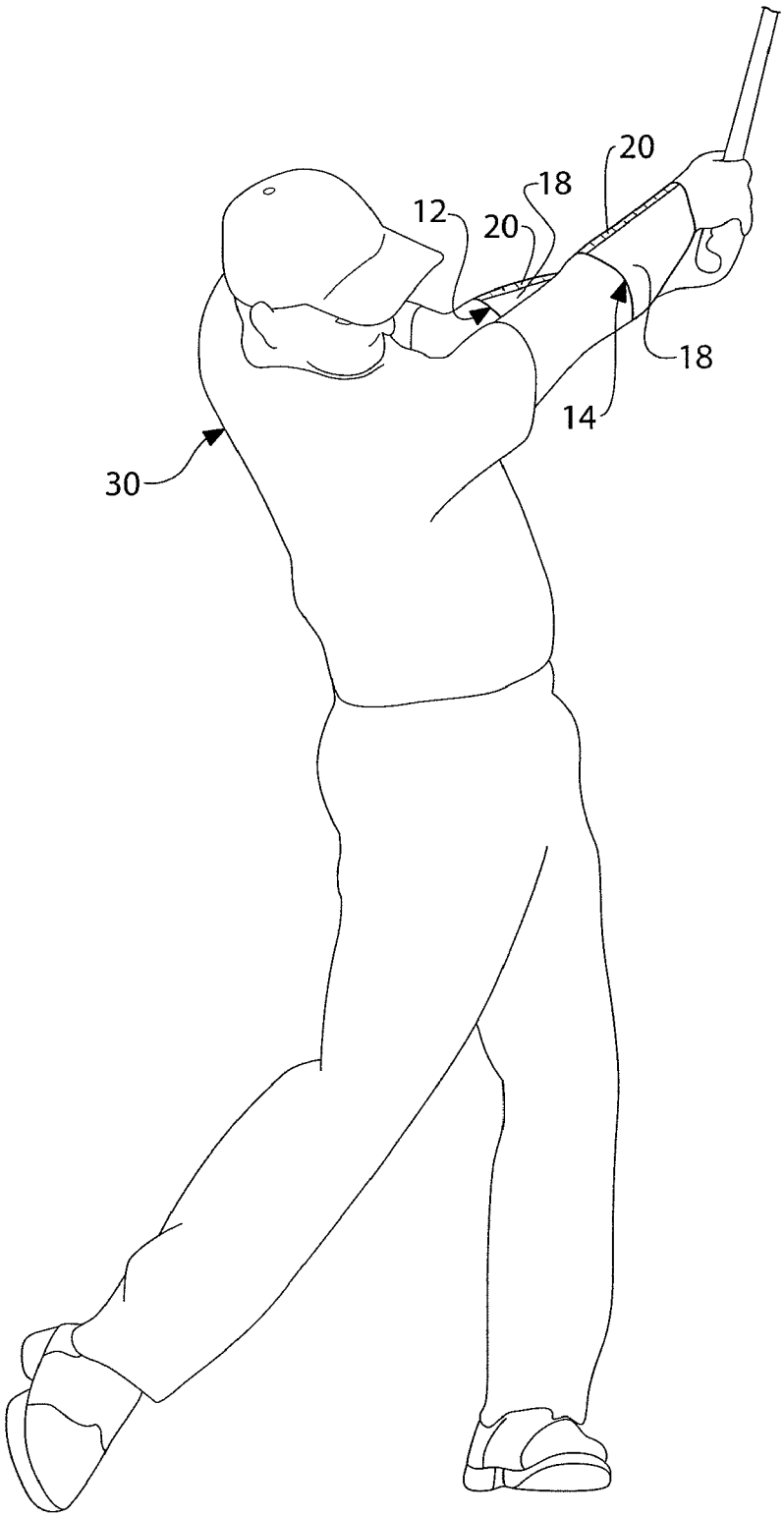
FIG. 5 shows the position of a golfer at the end of a proper forward swing.

The final checkpoint is illustrated in FIG. 5, which is at the completion of the golfer's forward swing. In this position, if the golfer's swing has been carried out properly only the visually distinguishable sections 18 of the sleeves are visible. This proper orientation of the training sleeves exists when the golfer finishes his/her stroke in a balanced; relaxed position.

A number of modifications/alternative constructions can be employed in this invention. For example, each of the sleeves 12, 14 can be formed from a single, flat panel of elastic material that is sewn into the closed, conical position and is dyed or otherwise treated to provide the visually distinguishable sections 16, 18 and 20. Alternatively, each of the sleeves 12, 14 can be formed from one or more panels that are stitched together; the panels either being dyed or made of visually distinguishable sections.

Although the preferred embodiment of this invention employs a pair of sleeves 12, 14 having elastic properties, it is understood that other structures also can be employed to surround and tightly engage the forearms of a golfer. For example, the training aides of this invention can include a pair of flat, flexible members that are designed to be wrapped tightly about respective forearms of a golfer and secured in that position by suitable fasteners, such as belts, Velcro fasteners, etc.

However, regardless of the specific shape or configuration of the members surrounding the forearms of a golfer, the members are required to have at least a pair of visually distinguishable sections, e.g., 16, 18, and most preferably an additional visually distinguishable section, e.g., 20 for use in properly positioning the members on the forearms of a golfer to assure that the pair of visually distinguishable sections 16, 18 are located in a proper orientation on the golfer's forearms to visually indicate whether a golf swing has been carried out in a proper manner by the golfer.

The golf training aide 10 of this invention provides a very easy mechanism to teach a golfer to engage in a proper golf swing and essentially deploys the three most common styles of learning; namely, visual, kinesthetic and auditory. By combining all three learning styles the golf training aide 10 simulates the three styles every time it is being used in a swing. Specifically, the pair of visually distinguishable sections 16, 18 and, when employed, the additional visually distinguishable sections 20, allow the golfer to visualize, or see, the positions; the snug fit of the golf training aide around the forearms of the user provides a kinesthetic effect by allowing the golfer to actually feel the sleeves on the forearms and how the forearms must be used to perform an effective swing; and a auditory function is provided by creating a mantra for the golfer to say that reflects the proper use of the forearms throughout the entire golf swing. Specifically, the mantra can be the constant repetition of the words "red, red" during the backswing of the golf club to identify the fact that the red sections of the sleeves are required to be presented forwardly, and then the repetition of the words "white, white" during portions of the swing when the white sections of the sleeves are required to be facing forwardly. The mantra will be used in the fashion of "red, red, white, white" during the swing so as to provide a proper rhythm and tempo for the swing.

Being able to rely on all three mechanisms during the learning phase allows the golfer to rely on the benefits of the mantra when the sleeves are not present.

Although the previously-discussed positions of a proper golf swing have been taught for as long as the game has been played, sometimes successfully and sometimes not, during a majority of the time it is a struggle for a golfer to repeat the proper maneuvers consistently and successfully. The golf training aide 10 of this invention, in the form of a pair of sleeves 12, 14 positioned snuggly about the forearms of the golfer with the above-described visually distinguishable sections 16, 18 and optionally 20, addresses the most difficult challenges of all in a golf swing, whether it is while putting, chipping, pitching or executing the full swing.

When a golfer is using the golf training aide 10 of this invention, he/she no longer is required to focus on the ball, the club, the hands or any of the many positions that must be achieved in a proper swing. With the golf training aide 10 of this invention the golfer only needs to focus on the location of the visually distinguishable sections 16, 18 of the properly positioned sleeves 12 and 14, and how the forearms rotate to create the proper exchange of the visually distinguishable sections 16, 18 during the swing. Thus, the golf swing becomes less tedious, less constricting and more fluid, creating a natural, powerful, consistent swing.

While this invention has been described in detail with reference to specific examples thereof, it should be apparent to those skilled in the art that various changes and modifications can be made therein without department from the spirit and scope thereof.

What is claimed is:

1. A golf training aide including a pair of separate and independent sleeves adapted to be placed on a golfer's forearm, said sleeves being separate from and unconnected to each other and each sleeve being independently movable from the other sleeve with the golfer's forearm on which each of said sleeves is placed, each sleeve including a pair of visually distinguishable sections, said sleeves being properly positionable on the golfer's forearm to orient one of the visually distinguishable sections of each sleeve facing forwardly at the end of a proper backswing of a golf club and to orient the other of the pair of visually distinguishable sections of each sleeve facing forwardly at the finish of the forward swing of the golf club.

2. The golf training aide of claim 1, wherein each sleeve includes an additional visually distinguishable section adapted to be aligned in a predetermined position to properly position the sleeves on the golfer's forearm to provide the desired training function.

3. The golf training aide of claim 2, wherein the additional visually distinguishable section of each sleeve is an elongate section between the pair of visually distinguishable sections.

4. The golf training aide of claim 3, wherein the additional visually distinguishable section of each sleeve has a transverse dimension narrower than the transverse dimension of each section of the pair of visually distinguishable sections.

5. The golf training aide of claim 4, wherein the additional visually distinguishable section and the sections of the pair of visually distinguishable sections of each sleeve are separate panels that are stitched together.

6. The golf training aide of claim 3, wherein each sleeve is properly positionable on a respective arm of the golfer with the additional, elongate section of each sleeve being generally aligned with the "V" between the golfer's thumb and forefinger of each respective hand.

7. The golf training aid of claim 6, wherein the additional elongate sections of the pair of sleeves are oriented in a generally V-shape when the golfer properly grips the golf club.

8. The golf training aide of claim 1, wherein each sleeve includes an elastic section.

9. A method of training a golfer to employ a proper golf swing includes the steps of: (a) providing a pair of separate and unconnected sleeves on a golfer's forearms, each sleeve being moveable with the golfer's forearm to which it is attached independently of the other sleeve, each sleeve including a pair of visually distinguishable sections, said sleeves being positioned on the golfer's arms to orient one of the visually distinguishable sections of each sleeve facing forwardly at the end of a proper backswing of a golf club and to orient the other of the pair of visually distinguishable sections of each sleeve facing forwardly at the finish of a proper forward swing of the golf club; and (b) instructing the golfer to provide a backswing that finishes with one of the visually distinguishable sections of each sleeve facing forwardly and then to provide a forward swing that finishes with the other of said visually distinguishable sections of each sleeve facing forwardly.

10. A golf training aide including a pair of sleeves adapted to be placed on a golfer's forearms, each sleeve including a pair of visually distinguishable sections, said sleeves being properly positionable on the golfer's forearms to orient one of the visually distinguishable sections of each sleeve facing forwardly at the end of a proper backswing of the golf club and to orient the other of the pair of visually distinguishable sections of each sleeve facing forwardly at the finish of the forward swing of the golf club, each sleeve including an additional visually distinguishable section adapted to be aligned in a predetermined position to properly position the sleeves on the golfer's forearms to provide the desired training function, said additional visually distinguishable section of each sleeve being an elongate section between the pair of visually distinguishable sections and having a transverse dimension narrower than the transverse dimension of each section of the pair of visually distinguishable sections, each additional visually distinguishable section and the sections of the pair of visually distinguishable sections of each sleeve being separate panels that are stitched together.

* * * * *